US008096746B2

(12) United States Patent
Durocher et al.

(10) Patent No.: US 8,096,746 B2
(45) Date of Patent: Jan. 17, 2012

(54) RADIAL LOADING ELEMENT FOR TURBINE VANE

(75) Inventors: Eric Durocher, Vercheres (CA); Yves Caron, Montreal (CA)

(73) Assignee: Pratt & Whitney Canada Corp., Longueuil (CA)

( * ) Notice: Subject to any disclaimer, the term of this patent is extended or adjusted under 35 U.S.C. 154(b) by 1068 days.

(21) Appl. No.: 11/955,867

(22) Filed: Dec. 13, 2007

(65) Prior Publication Data

US 2009/0155068 A1 Jun. 18, 2009

(51) Int. Cl.
*F01D 9/04* (2006.01)
*F01D 25/04* (2006.01)

(52) U.S. Cl. ..... 415/1; 415/119; 415/135; 415/136; 415/137; 415/209.2; 415/209.3; 415/209.4; 415/210.1

(58) Field of Classification Search ..... 415/119, 415/135–138, 189–190, 209, 2, 209.3, 209.4, 415/210.1, 1, 209.2
See application file for complete search history.

(56) References Cited

U.S. PATENT DOCUMENTS

| | | | | |
|---|---|---|---|---|
| 2,605,997 | A * | 8/1952 | Lombard et al. | 415/138 |
| 2,801,075 | A * | 7/1957 | Broffitt | 415/137 |
| 3,326,523 | A | 6/1967 | Bobo | |
| 3,394,919 | A | 7/1968 | Catterfield | |
| 3,529,906 | A * | 9/1970 | Borden et al. | 415/210.1 |
| 3,857,649 | A | 12/1974 | Schaller et al. | |
| 4,363,600 | A | 12/1982 | Thebert | |
| 4,470,754 | A * | 9/1984 | Manente et al. | 415/136 |
| 4,516,910 | A | 5/1985 | Bouiller et al. | |
| 4,721,434 | A | 1/1988 | Marshall et al. | |
| 4,897,021 | A | 1/1990 | Chaplin et al. | |
| 5,681,142 | A | 10/1997 | Lewis | |
| 6,409,472 | B1 | 6/2002 | McMahon et al. | |
| 6,543,996 | B2 * | 4/2003 | Koschier | 415/200 |
| 6,761,538 | B2 | 7/2004 | Fitts et al. | |
| 6,932,566 | B2 | 8/2005 | Suzumura et al. | |
| 6,969,239 | B2 | 11/2005 | Grant et al. | |
| 7,762,768 | B2 * | 7/2010 | Shi et al. | 415/209.3 |
| 2006/0127215 | A1 * | 6/2006 | Durocher et al. | 415/191 |

* cited by examiner

*Primary Examiner* — Christopher Verdier
(74) *Attorney, Agent, or Firm* — Norton Rose OR LLP

(57) ABSTRACT

A vane assembly for a gas turbine engine comprising a number of radial loading elements disposed between lugs of the vane ring and the vane support, such as to generate a radial load force against the vane ring. The radial load force prevents unwanted relative movement between the vane ring and the vane support during operation of the gas turbine engine.

19 Claims, 6 Drawing Sheets

RADIAL LOADING ELEMENT FOR TURBINE VANE

TECHNICAL FIELD

The present invention relates generally to gas turbine engines, and more particularly to turbine vane assemblies thereof.

BACKGROUND OF THE INVENTION

The turbine section of gas turbine engines typically includes a number of stages of turbine vanes, each composed of a plurality of radially extending vanes which are mounted within a support structure and often comprise vane ring assemblies. Each of the turbine vanes segments is mounted within a surrounding support of the vane ring assembly. While the turbine vanes must be maintained in place, sufficient allowance must be made for thermal growth differential between the vanes and their supporting structure, give the high temperatures to which the turbine vanes are exposed. As such, a given amount of axial and/or radial looseness is provided between the vane and its support, such as to permit thermal growth and thus to allow for axial and/or radial movement of the vane within the support while minimizing any potential friction therebetween. However, such tolerances which allow for thermal growth can sometimes cause undesirable movement of the vanes at certain temperatures, which can lead to engine vibration.

SUMMARY OF THE INVENTION

It is an object to provide an improved turbine vane assembly for a gas turbine engine.

In accordance with one aspect of the present invention, there is provided a vane assembly for a gas turbine engine, the vane assembly comprising an inner vane support and a vane ring, the vane ring including a plurality of airfoils radially extending between inner and outer vane platforms, the vane assembly being concentric with a longitudinal axis of the gas turbine engine, the vane ring having a plurality of lug members radially protruding therefrom, each lug member being disposed in radial sliding engagement with a corresponding recess of the vane support such as to at least partially support and position the vane ring in place within the gas turbine engine, and wherein a radial loading element is disposed between a remote end of each of the lug members and the vane support, the radial loading elements generating a radial load force against the vane ring such as to radially bias the vane ring relative to the vane support, thereby limiting relative radial movement between the vane ring and the vane support during operation of the gas turbine engine.

There is also provided, in accordance with another aspect of the present invention, a vane assembly for a gas turbine engine, the vane assembly comprising an inner vane support and a vane ring, the vane ring including a plurality of airfoils radially extending between inner and outer vane platforms, the vane assembly being concentric with a longitudinal axis of the gas turbine engine, the vane ring having a plurality of lug members radially protruding therefrom, each lug member being disposed in radial sliding engagement with a corresponding recess of the vane support such as to at least partially support and position the vane ring in place within the gas turbine engine, and a means for generating a radial load force against the vane support, said means radially biasing the vane ring relative to the vane support thereby limiting relative radial movement between the vane ring and the vane support during operation of the gas turbine engine.

There is further provided, in accordance with another aspect of the present invention, a method of reducing vibration in a gas turbine engine having a turbine vane assembly including a vane ring and a vane support, the vane ring having a plurality of airfoils radially extending between an inner and outer vane platforms defining a gas path therebetween, the vane ring being concentric with a longitudinal axis of the gas turbine engine, the method comprising generating a substantially constant radial load against the vane ring at a number of equally circumferentially distributed points thereon outside of the gas path, thereby radially biasing the vane ring relative to the vane support.

BRIEF DESCRIPTION OF THE DRAWINGS

Further features and advantages of the present invention will become apparent from the following detailed description, taken in combination with the appended drawings, in which.

DETAILED DESCRIPTION OF A PREFERRED EMBODIMENT

Figure 1:
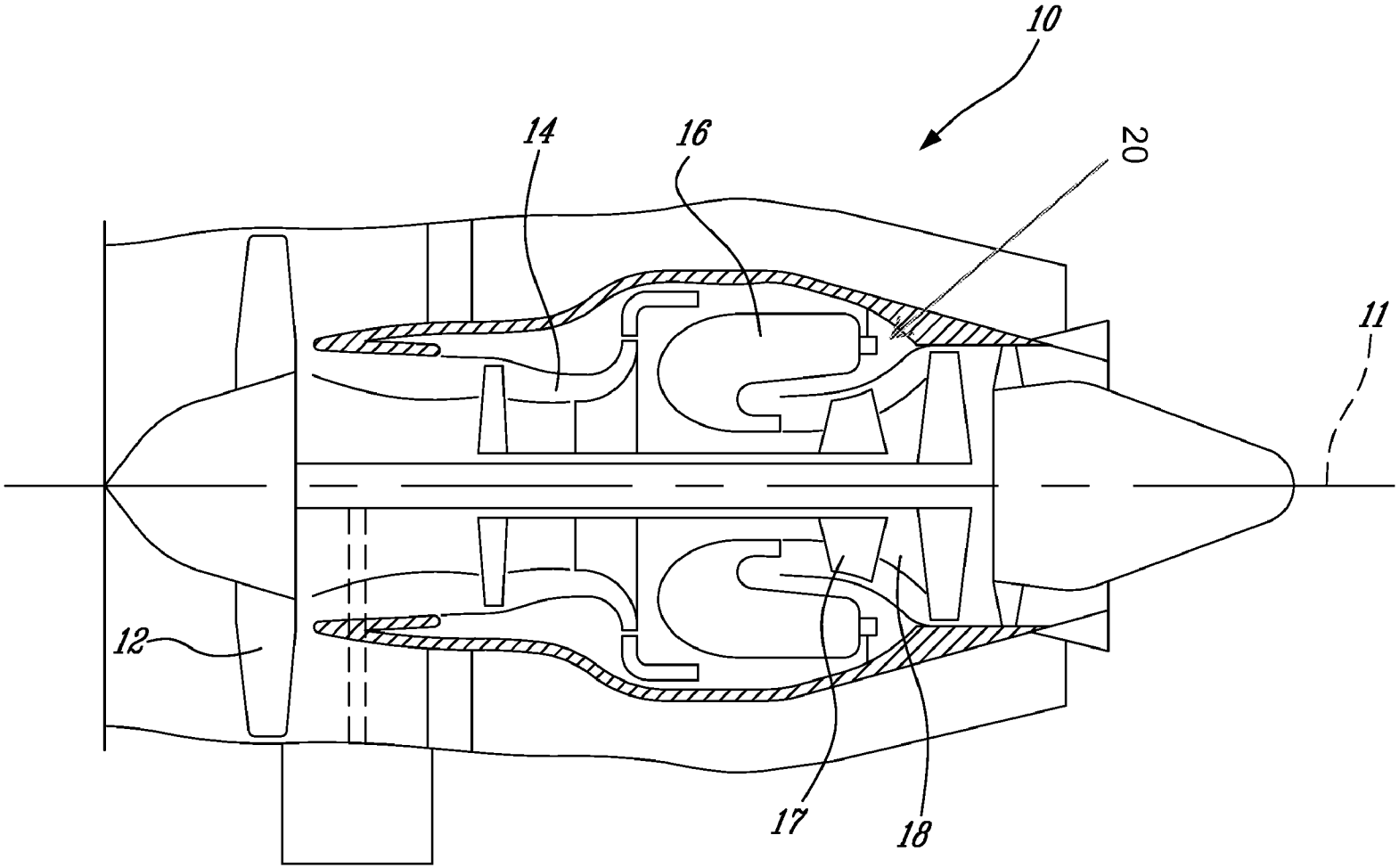
FIG. 1 is schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Fuel is injected into the combustor 16 of the gas turbine engine 10 by a fuel injection system 20 which is connected in fluid flow communication with a fuel source (not shown) and is operable to inject fuel into the combustor 16 for mixing with the compressed air from the compressor 14 and ignition of the resultant mixture. The fan 12, compressor 14, combustor 16, and turbine 18 are preferably all concentric about a common central longitudinal axis 11 of the gas turbine engine 10.

Figure 2:
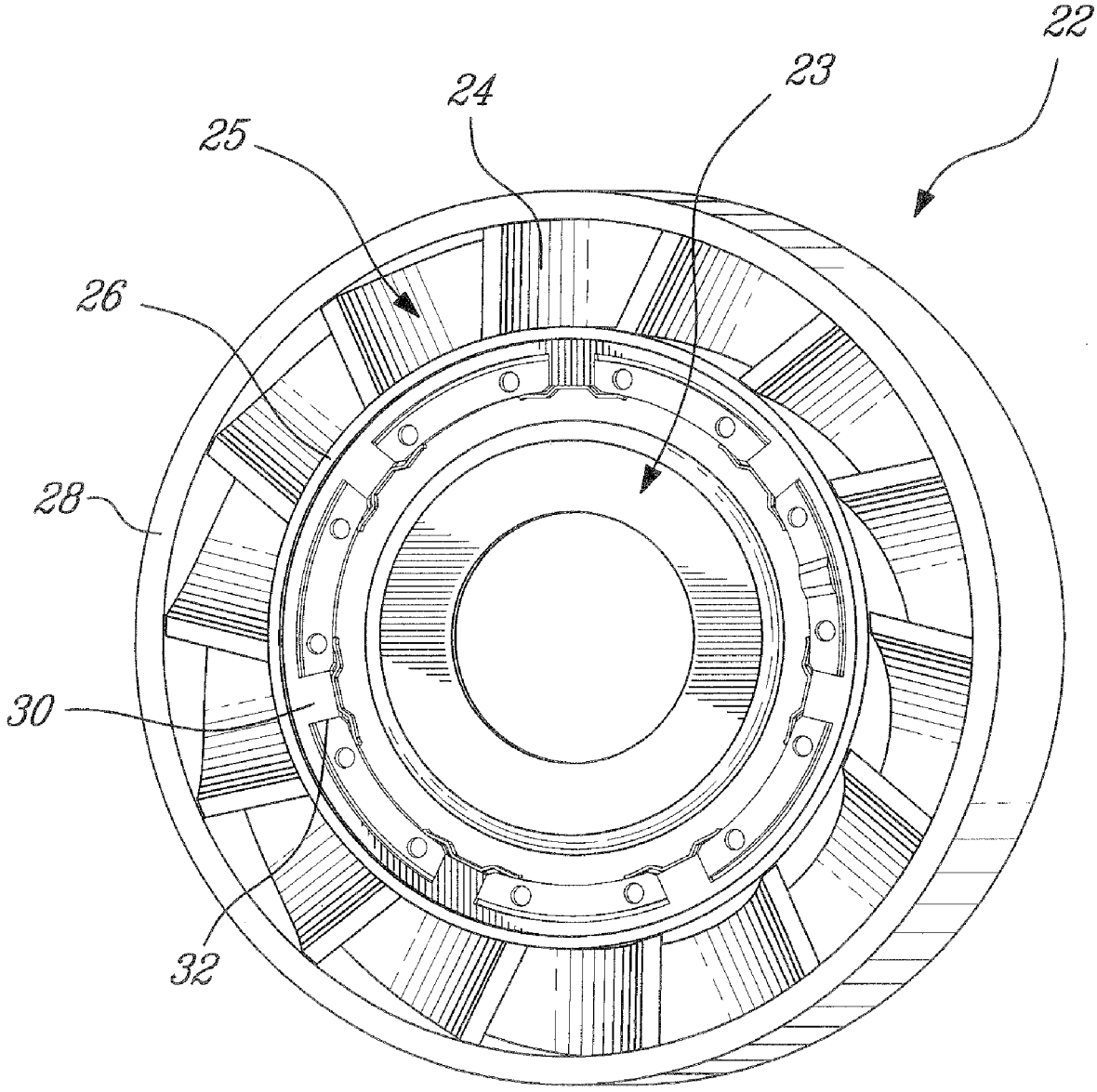
FIG. 2 is a perspective view of a turbine vane assembly in accordance with one aspect of the present invention.

The turbine section 18 of the gas turbine engine 10 may comprise one or more turbine stages. In FIG. 1, two turbine stages are shown, including a first, or high pressure (HP), turbine stage 17, which includes a rotating turbine rotor (not shown) with a plurality of radially extending turbine blades and a static turbine vane assembly 22, as shown in FIG. 2, which is mounted upstream of the turbine rotor. The HP turbine vane assembly 22 is disposed immediately downstream from the exit of the combustor 16.

Referring in more detail to FIG. 2, the turbine vane assembly 22 of the HP turbine stage 17 is shown. The turbine vane assembly 22 comprises generally an inner vane support 23 and a vane ring assembly 25 mounted thereto. The vane support 23 is fixed to a support structure within the engine. This may be done using bolts or other attachment means to fix the vane support in place 23. The vane ring assembly 25 includes a plurality of airfoils 24 which extend substantially radially between an inner vane platform 26 and an outer vane platform 28, which define an annular gas flow passage therebetween. The outer vane platform 28 engages an outer combustion chamber wall and the inner vane platform 26 engages an inner combustion chamber wall, thereby defining therebetween the annular hot gas path from the combustion chamber outlet through the annular passage of the vane assembly 22.

The vane ring 25 includes at least one airfoil radially extending between the inner and an outer vane platforms 26, 28 of the ring. The turbine vane ring 25 is a one-piece annular stator vane ring.

Figure 3:
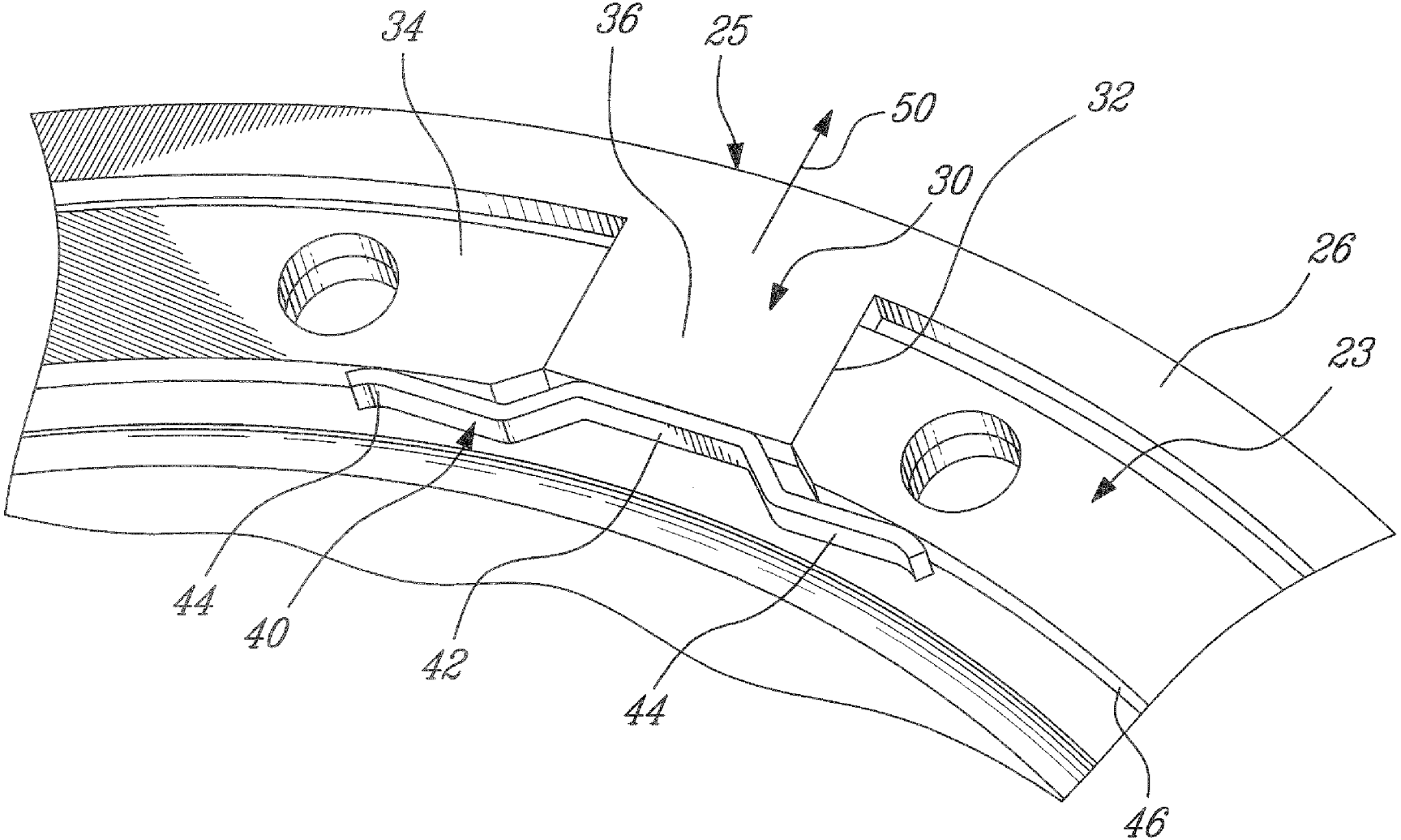
FIG. 3 is a perspective view of a portion of the turbine vane assembly of FIG. 2, showing the vane ring mounted on the inner vane support.

The vane ring 25 is mounted by a mounting configuration which includes a number of interlocking lugs 30 disposed on at least the inner platform of the vane ring, and alternately on at least one of the inner and outer vane platforms, and cooperating recesses 32 which receive the lugs 30. More specifically, as best seen in FIG. 3, a number of lugs 30 radially inwardly protrude from the inner vane platform 26 of the vane ring assembly 25. Each of these lugs 30 are received within corresponding recesses 32 formed in the radially outer periphery 34 of the vane support 23. The cooperating lugs 30 and recesses 32 thereby prevent circumferential relative movement between the vane support 23 and the vane ring 25 of the vane assembly 22, while nevertheless allowing for some radial displacement and/or growth differential therebetween. However, in order to limit unwanted or excess radial displacement of the vane ring 25 relative to its vane support 23, the present vane assembly 22 includes a number of radial loading elements 40 which apply a substantially constant outwardly-directed radial load against the turbine vane ring 25, such as to thereby avoid movement of the vane ring 25 which can cause undesirable engine vibration.

Figure 4:
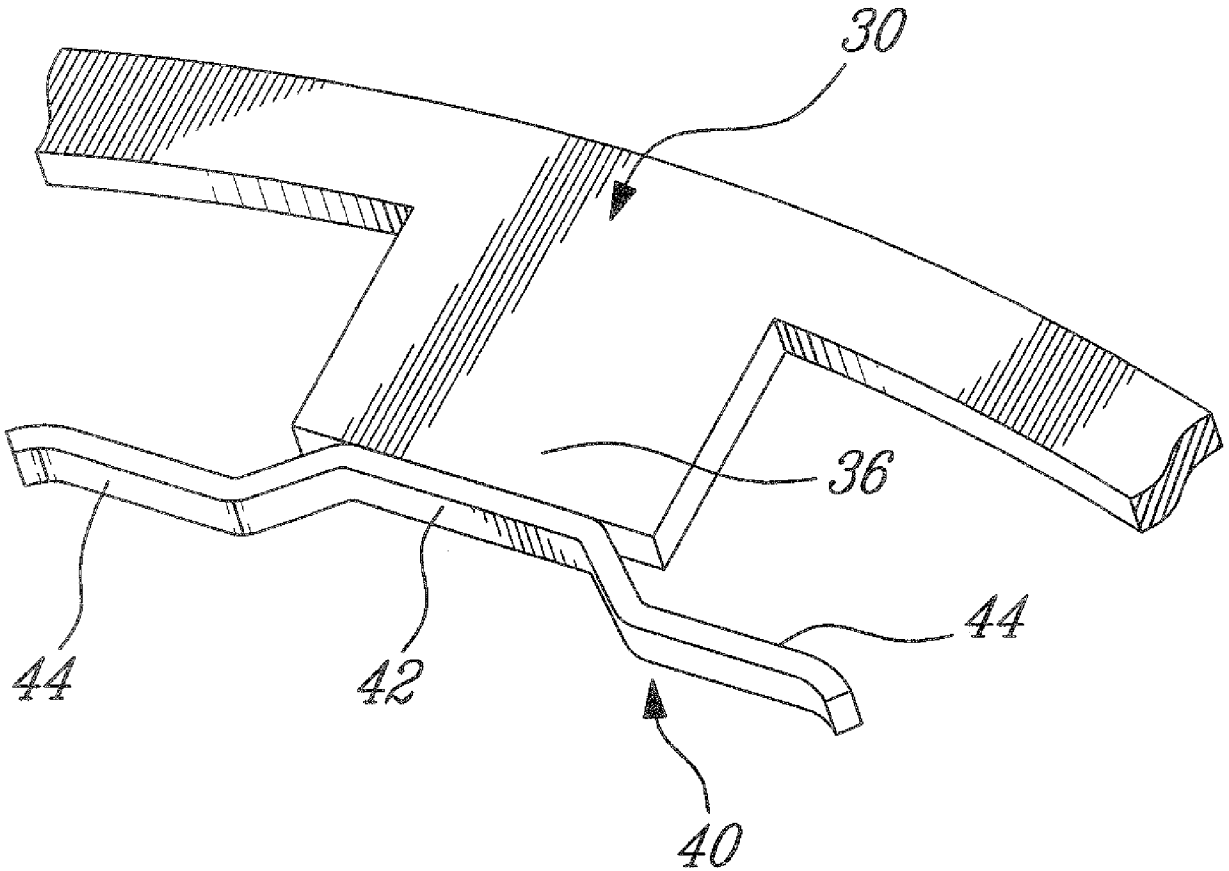
FIG. 4 is a perspective view of a portion of the turbine vane assembly of FIG. 2, showing only a portion of the vane ring in isolation.
Figure 5:
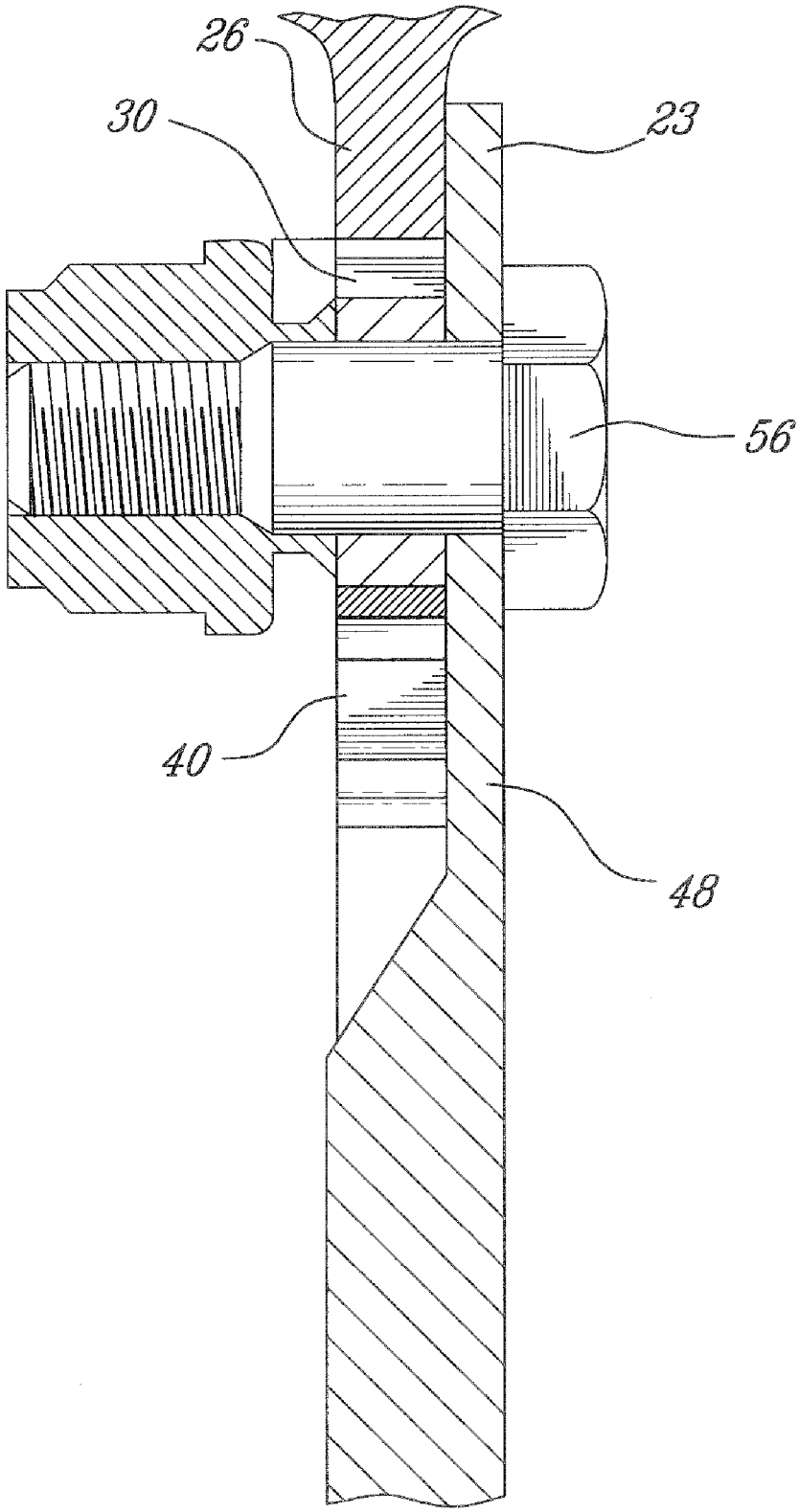
FIG. 5 is a partial cross-sectional view of the turbine vane assembly of FIG. 2.

Referring to FIGS. 3-5, each of the locating lugs 30 of the vane ring 25 includes a radial loading element 40 fixed to a radially inner end 36 of the lug 30. The radial loading element 40 can also be fixed to the underside of the remote end 36 of the vane lug 30 by a number of methods, including welding, brazing and/or riveting. The radial loading element 40 comprises, in one embodiment, a thin elongated piece of sheet metal that is bent and inserted under the vane lug 30 between the vane lug and the vane support member 23 during installation of the vane assembly 22. More specifically, in at least one embodiment, the radial loading element 40 includes a leaf-type spring which has a central portion 42 and two protruding outer spring arms 44 which extend circumferentially away from the central portion 42. The central portion 42 of the radial loading element 40 is fixed to the remote, or radial inner, end 36 of the lug 30, and the outer spring arms 44 are received within a channel 46 formed in the radially outer periphery 34 of the vane support 23. The outer spring arms 44 abut at least one inner surface of the channel 46, and are configured such as to exert a radially-directed biasing force on the lug 30 to which the radial loading element 40 is fixed. Accordingly, each of the circumferentially spaced apart radial loading elements 40 exerts a radially directed biasing force on the vane ring 25, which forces the vane ring 25 to maintain a concentric and centralized position within the engine relative to the central longitudinal axis 11, while preventing excessive radial movement of the vane ring 25 relative to its vane support 23. This accordingly reduces overall vibration when the gas turbine engine is in operation, as radial displacement of the vane ring 25 is limited. This is particularly useful when the engine is running at low power or at transient conditions where aerodynamic force may be insufficient to keep the vane ring in place.

The term 'radial' as used herein is intended to refer to a direction which lies in a plane that is substantially perpendicular to the longitudinal engine axis 11 of the gas turbine engine 10, and which extends away from the longitudinal axis 11 as a radius of a circle having the axis 11 at its center.

Figure 6:
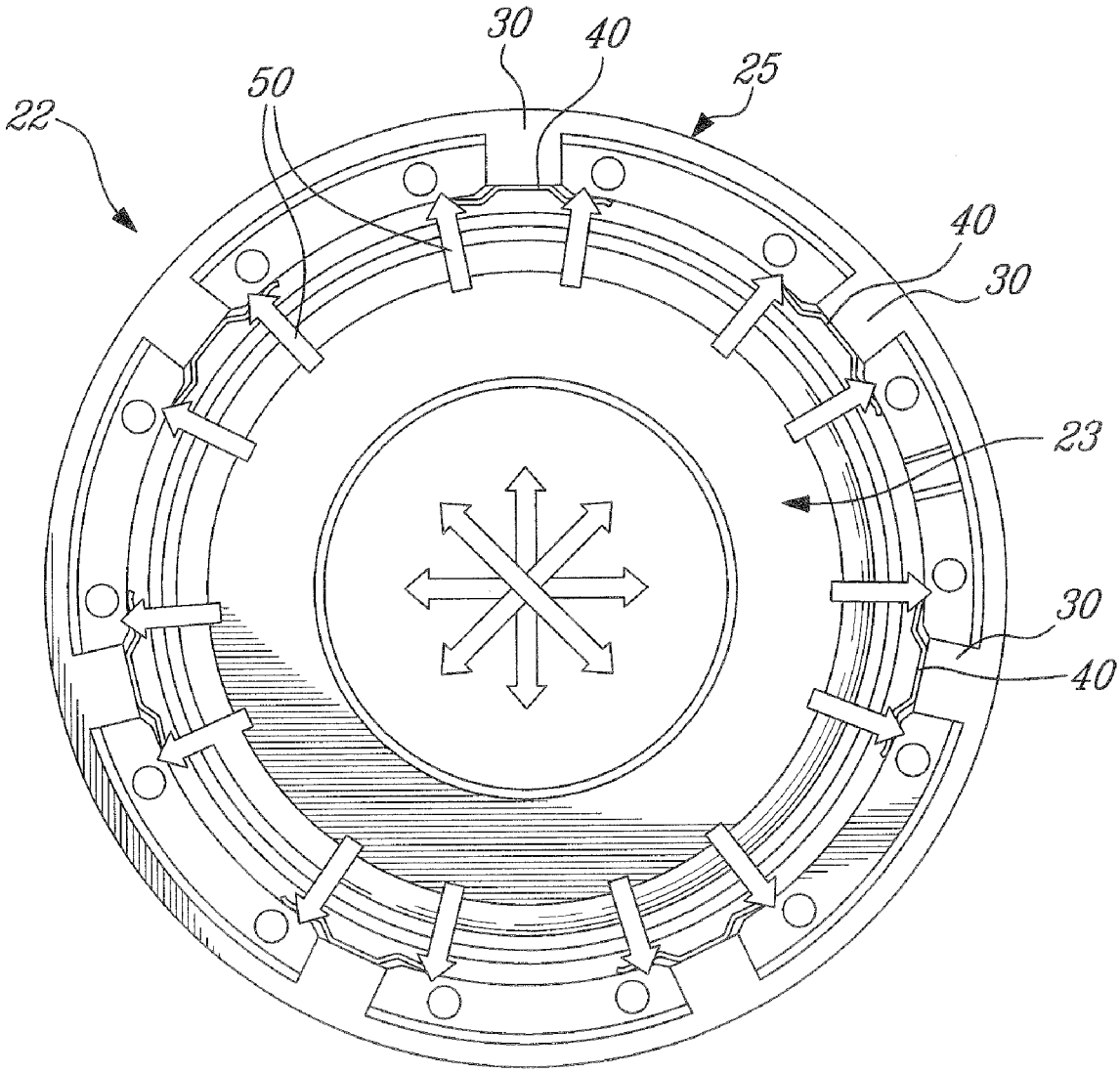
FIG. 6 is a schematic front elevation view of the turbine vane assembly of FIG. 2, showing radial expansion thereof.

The radial loading element 40 may be made of spring steel or another suitable material, provided sufficient resilience is present to permit the radial loading element 40 to naturally return to its un-sprung position (as shown in FIG. 4), such than when the radial loading element 40 is compressed in position within the channel 46 of the vane support 23 (as shown in FIG. 3), the radial loading element 40 biases the lug 30 of the vane ring 25 in an outwardly radial direction 50 as seen in FIGS. 3 and 6. The radial loading element 40 is installed in a biased state so that it constantly exerts a radial force on the vane relative to the vane support member. The radial load force exerted on the vane ring 25 by the radial loading element 40 also increases as the vane grows in the radial direction due to thermal expansion.

As seen in FIG. 5, the vane support 23 is mounted within a supporting structure 48 of the engine via a number of circumferentially distributed fasteners 56. However, the vane ring 25 is mounted to the vane support 23 by the lugs 30 which are radially biased by the radial loading elements 40 as described above, such that radial movement of the lugs 30, and therefore entire vane ring 25, remains possible in a radial direction relative to the fixed vane support 23, such as to allow for radial thermal growth differential and/or relative radial movement between the vane ring 25 and the vane support 23 during operation of the gas turbine engine. The radial loading elements 40 also help to improve the sealing efficiency of the vane ring 25 within the engine and to reduce fretting on the parts supported by the vane ring assembly.

Although the radial loading element 40 is depicted and described in the above embodiment as a leaf-type spring, it is to be understood that the radial loading elements 40 may be formed in a variety of other manners and having a number of alternate configurations. Other forms, shapes and configurations of spring elements are also possible, providing they are able to generate a spring load force in a radial direction when mounted between each lug 30 of the vane ring 25 and the van support 23. Further, although the leaf-springs shown and described herein are individual elements, each one being fixed to one of the locating lug members 30, the radial loading elements 40 could in fact be composed of a single annular ring which fits for example within the channel 46 of the vane support and includes abutting portions which engage each of the lugs at openings in the circumferential channel.

The constant and balanced radial force generated by the radial loading elements 40 and which is applied against the turbine vane ring 25 of the vane assembly 22 therefore avoids unwanted relative movement between the turbine vane ring 25 and the vane support 23, which accordingly reduces unwanted engine vibration. This constant and balanced radial load force is particularly useful when the engine is running at low power or at transient power conditions, as the reduced axial aerodynamic force (relative to the higher aerodynamic forces which act against the vane assembly at higher power conditions) which acts on the vane assembly are less effective at keeping the vane ring in place. The radial loading elements 40 nevertheless permits for radial growth differential and/or relative radial movement, without requiring any radial "looseness" in order to accommodate such thermal growth of the hot vane ring relative to the cooler vane support. Friction wear between the vane ring and the vane support is also reduced by the use of the radial loading elements 40.

As a result of the reduced vane displacement which occurs during engine operation when the radial loading elements 40 are provided in the vane assembly 22, several other benefits are also achieved. In tests, these benefits have been found to include: the significant reduction in engine vibration; reduce wear or fretting on the support structure engaged with the vane; improved lifespan of seals disposed between the vane assembly and the other components of the engine; and the improved sealing efficient which thereby improves the stability of overall engine performance. For example, in one set of tests wherein a gas turbine engine having a vane assembly 22 with radial loading elements 40 was run on a test rig, a reduction of 30%-50% in overall engine vibration was measured.

Although the vane assembly 22 has been described herein with reference to a turbine vane assembly, it is to be understood that the present vane assembly 22 can also be used in the compressor section of the engine as a compressor vane assembly. The mounting structure and radial load element described above are equally applicable to a compressor vane assembly if desired. Further, although the radial load element has been described above with respect to the inner vane platform mounting structure, it is to be understood that such a radial load element can also be provided between a mounting member of the vane outer platform and the corresponding support structure, in addition to or in place of that used for engaging the vane inner platform to the support structure within the engine.

The embodiments of the invention described above are intended to be exemplary. Those skilled in the art will therefore appreciate that the forgoing description is illustrative only, and that various other alternatives and modifications can be devised without departing from the spirit of the present invention as defined by the appended claims. Accordingly, the present is intended to embrace all such alternatives, modifications and variances which fall within the scope of the appended claims.

The invention claimed is:

1. A vane assembly for a gas turbine engine, the vane assembly comprising an inner vane support and a vane ring, the vane ring including a plurality of airfoils radially extending between inner and outer vane platforms, the vane assembly being concentric with a longitudinal axis of the gas turbine engine, the vane ring having a plurality of lug members radially protruding therefrom, each lug member being disposed in radial sliding engagement with a corresponding recess of the vane support such as to at least partially support and position the vane ring in place within the gas turbine engine, and wherein a radial loading element is disposed between a remote end of each of the lug members and the vane support, the radial loading elements generating a radial load force against the vane ring such as to radially bias the vane ring relative to the vane support, thereby limiting relative radial movement between the vane ring and the vane support during operation of the gas turbine engine.

2. The vane assembly as defined in claim 1, wherein said radial loading element is fixed to the remote each of said one of said lug members.

3. The vane assembly as defined in claim 1, wherein the lug members are equally distributed about the vane ring.

4. The vane assembly as defined in claim 3, wherein the radial loading elements generate a balanced annular radial load on the vane ring.

5. The vane assembly as defined in claim 1, wherein the radial loading elements generate a radially outward load force against the vane ring.

6. The vane assembly as defined in claim 1, wherein at least the inner platform of the vane ring has the lug members thereon.

7. The vane assembly as defined in claim 4, wherein the lug members radially inwardly protrude from an inner circumference of the inner platform.

8. The vane assembly as defined in claim 1, wherein the vane ring surrounds the vane support.

9. The vane assembly as defined in claim 1, wherein the radial load force is directed in a radial direction which is perpendicular to an axial aerodynamic load exerted upon the vane ring during operation of the gas turbine engine.

10. The vane assembly as defined in claim 1, wherein the radial loading element is a leaf spring.

11. The vane assembly as defined in claim 1, wherein the vane assembly is a turbine vane assembly.

12. The vane assembly as defined in claim 1, wherein the radial loading elements are all integrally formed to define a single annular ring spring.

13. A vane assembly for a gas turbine engine, the vane assembly comprising an inner vane support and a vane ring, the vane ring including a plurality of airfoils radially extending between inner and outer vane platforms, the vane assembly being concentric with a longitudinal axis of the gas turbine engine, the vane ring having a plurality of lug members radially protruding therefrom, each lug member being disposed in radial sliding engagement with a corresponding recess of the vane support such as to at least partially support and position the vane ring in place within the gas turbine engine, and a means for generating a radial load force against the vane support, said means radially biasing the vane ring relative to the vane support thereby limiting relative radial movement between the vane ring and the vane support during operation of the gas turbine engine.

14. The vane assembly as defined in claim 13, wherein said means includes a plurality of radial loading elements disposed about the vane ring.

15. The vane assembly as defined in claim 14, wherein the radial loading elements include leaf springs.

16. The vane assembly as defined in claim 14, wherein the radial loading elements are disposed between a remote end of each of the lug members and the vane support.

17. The vane assembly as defined in claim 14, wherein the radial loading elements generate a radially outward load force against the vane ring.

18. A method of reducing vibration in a gas turbine engine having a turbine vane assembly including a vane ring and a vane support, the vane ring having a plurality of airfoils radially extending between inner and outer vane platforms defining a gas path therebetween, the vane ring being concentric with a longitudinal axis of the gas turbine engine, the method comprising generating a substantially constant radial load against the vane ring at a number of equally circumferentially distributed points thereon outside of the gas path by providing radial loading elements which are disposed between a lug member on at least one of the inner and outer vane platforms and the vane support and using the radial loading elements to exert individual radial load forces about the vane ring, thereby radially biasing the vane ring relative to the vane support.

19. The method of claim 18, further comprising exerting the radial load on the inner platform of the vane ring in a radially outer direction.

* * * * *